US005607025A

United States Patent [19]

Mensa-Wilmot et al.

[11] Patent Number: 5,607,025

[45] Date of Patent: Mar. 4, 1997

[54] DRILL BIT AND CUTTING STRUCTURE HAVING ENHANCED PLACEMENT AND SIZING OF CUTTERS FOR IMPROVED BIT STABILIZATION

[75] Inventors: Graham Mensa-Wilmot, Houston; Carl W. Keith, Spring, both of Tex.

[73] Assignee: Smith International, Inc., Houston, Tex.

[21] Appl. No.: 465,061

[22] Filed: Jun. 5, 1995

[51] Int. Cl.[6] ..... E21B 10/46

[52] U.S. Cl. ..... 175/431

[58] Field of Search ..... 175/431, 430, 175/428

[56] References Cited

U.S. PATENT DOCUMENTS

| | | | |
|---|---|---|---|
| Re. 33,757 | 12/1991 | Weaver | 175/329 |
| Re. 34,435 | 11/1993 | Warren et al. | 175/398 |
| 2,947,608 | 8/1960 | Hall | 23/209.1 |
| 2,947,617 | 8/1960 | Wentorf | 51/307 |
| 3,518,756 | 7/1970 | Bennett et al. | 29/625 |
| 3,743,556 | 7/1973 | Breton et al. | 156/62.8 |
| 3,778,586 | 12/1973 | Breton et al. | 219/76 |
| 3,819,814 | 6/1974 | Pope | 423/416 |
| 3,876,447 | 4/1975 | Lally | 117/22 |
| 4,036,937 | 7/1977 | Roy et al. | 423/446 |
| 4,098,362 | 7/1978 | Bonnice | 175/430 |
| 4,194,040 | 3/1980 | Breton et al. | 428/308 |
| 4,329,271 | 5/1982 | Kemr et al. | 524/386 |
| 4,351,401 | 9/1982 | Fielder | 175/428 |
| 4,353,958 | 10/1982 | Kita | 428/329 |
| 4,429,755 | 2/1984 | Williamson | 175/329 |
| 4,444,281 | 4/1984 | Schumacher et al. | 175/336 |
| 4,471,845 | 9/1984 | Jurgens | 175/329 |
| 4,475,606 | 10/1984 | Crow | 175/410 |
| 4,499,958 | 2/1985 | Radtke et al. | 175/428 |
| 4,522,633 | 6/1985 | Dyer | 51/307 |
| 4,525,178 | 6/1985 | Hall | 51/309 |
| 4,545,441 | 10/1985 | Williamson | 175/329 |
| 4,932,484 | 6/1990 | Warren et al. | 175/329 |
| 4,972,637 | 11/1990 | Dyer | 51/295 |
| 5,007,207 | 4/1991 | Phaal | 51/204 |
| 5,033,560 | 7/1991 | Sawyer et al. | 175/410 |
| 5,131,478 | 7/1992 | Brett et al. | 175/57 |
| 5,164,247 | 11/1992 | Solanki et al. | 428/213 |
| 5,178,222 | 1/1993 | Jones et al. | 175/398 |
| 5,186,286 | 2/1993 | Clegg | 175/399 |
| 5,222,566 | 6/1993 | Taylor et al. | 175/431 |
| 5,238,075 | 8/1993 | Keith et al. | 175/431 |
| 5,265,685 | 11/1993 | Keith et al. | 175/431 |
| 5,346,025 | 9/1994 | Keith et al. | 175/57 |
| 5,377,773 | 1/1995 | Tibbitts | 175/397 |

FOREIGN PATENT DOCUMENTS

| | | | |
|---|---|---|---|
| 2086451 | 5/1982 | United Kingdom | 175/431 |

OTHER PUBLICATIONS

Moreno, Rodrigo,, "The Role of Slip Additives in Tape Casting Technology: Part I—Solvents and Dispersants," *American Ceramic Society Bulletin,* vol. 71, No. 10 (Oct. 1992), pp. 1521–1531.

Moreno, Rodrigo, "The Role of Slip Additives in Tape Casting Technology: Part II—Binders and Plasticizers," *American Ceramic Society Bulletin,* vol. 71, No. 11 (Nov. 1992), pp. 1647–1657.

(List continued on next page.)

*Primary Examiner*—Hoang C. Dang

*Attorney, Agent, or Firm*—Gregory L. Maag; Conley, Rose & Tayon, P.C.

[57] ABSTRACT

A fixed cutter drill bit includes cutter elements mounted in sets on the bit face. A cutter element set includes at least three cutters with cutting faces having at least two different curvatures. The cutter elements of the set are mounted on various blades of the bit such that, in rotated profile, the cutting profile of a larger and a smaller cutter element overlap, and such that the smaller cutter element is flanked by larger sized cutters. The bit exhibits increased stability, before and after wear has occurred. The large cutters provide for efficient shearing while the smaller cutters may provide prefracturing in certain formations.

24 Claims, 5 Drawing Sheets

OTHER PUBLICATIONS

Product information sheets: "DeBeers Standard PCD Product Range: Syndite Cutting Tools, Syndite Macrodrill Inserts, Syndic Wire Drawing Die Blanks, Syndax3 Thermally Stable Inserts," published by DeBeers Industrial Diamond Division, 10 pages.

Product information sheets: "GE Superabrasives: STRATAPAX™ Drill Blank Products", GEOSET™ Drill Diamond Products, GES 511–516 (Feb. 1989), published by General Electric, Worthington, OH, 2 pages.

Product information booklet: "MegaDiamond Advanced Polycrystalline Diamond Technology," SD–1050 5M (Jun. 1991), published by Smith International, Houston, Texas, 12 pages.

DRILL BIT AND CUTTING STRUCTURE HAVING ENHANCED PLACEMENT AND SIZING OF CUTTERS FOR IMPROVED BIT STABILIZATION

FIELD OF THE INVENTION

This invention relates generally to fixed cutter drill bits of the type used in cutting rock formation such as used in drilling an oil well or the like. More particularly, the invention relates to bits utilizing polycrystalline diamond cutting elements that are mounted on the face of the drill bit, such bits typically referred to as "PDC" bits.

BACKGROUND OF THE INVENTION

In drilling a borehole in the earth, such as for the recovery of hydrocarbons or for other applications, it is conventional practice to connect a drill bit on the lower end of an assembly of drill pipe sections which are connected end-to-end so as to form a "drill string." The drill string is rotated by apparatus that is positioned on a drilling platform located at the surface of the borehole. Such apparatus turns the bit and advances it downwardly, causing the bit to cut through the formation material by either abrasion, fracturing, or shearing action, or through a combination of all cutting methods. While the bit is rotated, drilling fluid is pumped through the drill string and directed out of the drill bit through flow channels that are formed in the bit. The drilling fluid is provided to cool the bit and to flush cuttings away from the cutting structure of the bit and upwardly into the annulus formed between the drill string and the borehole.

Many different types of drill bits and cutting structures for bits have been developed and found useful in drilling such boreholes. Such bits include fixed cutter bits and roller cone bits. The types of cutting structures include milled tooth bits, tungsten carbide insert ("TCI") bits, PDC bits, and natural diamond bits. The selection of the appropriate bit and cutting structure for a given application depends upon many factors. One of the most important of these factors is the type of formation that is to be drilled, and more particularly, the hardness of the formation that will be encountered. Another important consideration is the range of hardnesses that will be encountered when drilling through layers of differing formation hardness.

Depending upon formation hardness, certain combinations of the above-described bit types and cutting structures will work more efficiently and effectively against the formation than others. For example, a milled tooth bit generally drills relatively quickly and effectively in soft formations, such as those typically encountered at shallow depths. By contrast, milled tooth bits are relatively ineffective in hard rock formations as may be encountered at greater depths. For drilling through such hard formations, roller cone bits having TCI cutting structures have proven to be effective. For certain hard formations, fixed cutter bits having a natural diamond cutting structure provide the best combination of penetration rate and durability. In formations of soft and medium hardness, fixed cutter bits having a PDC cutting structure are employed with good results.

The cost of drilling a borehole is proportional to the length of time it takes to drill the borehole to the desired depth and location. The drilling time, in turn, is greatly affected by the number of times the drill bit must be changed before reaching the targeted formation. This is the case because each time the bit is changed the entire drill string, which may be miles long, must be retrieved from the borehole section by section. After the drill string is retrieved and the new bit installed, the bit must be lowered to the bottom of the borehole on the drill string which again must be constructed section by section. As is thus obvious, this process, known as a "trip" of the drill string, requires considerable time, effort and expense. Accordingly, it is always desirable to employ drill bits which will drill faster and longer and which are usable over a wider range of differing formation hardnesses.

The length of time that a drill bit may be employed before it must be changed depends upon its durability or ability to maintain a high or acceptable rate of penetration ("ROP"). Additionally, a desirable characteristic of the bit is that it be "stable" and resist vibration, the most severe type or mode of which is "whirl," which is a term used to describe the phenomenon where a drill bit rotates at the bottom of the borehole about a rotational axis that is offset from the geometric center of the drill bit. Such whirling subjects the cutting elements on the bit to increased loading, which causes the premature wearing or destruction of the cutting elements and decreased penetration rates.

In recent years, the PDC bit has become an industry standard for cutting formations of soft and medium hardnesses. The cutting elements used in such bits are formed of extremely hard materials and include a layer of polycrystalline diamond material. In the typical PDC bit, each cutter element or assembly comprises an elongate and generally cylindrical support member which is received and secured in a pocket formed in the surface of the bit body. A disk or tablet-shaped, preformed cutting element having a thin, hard cutting layer of polycrystalline diamond is bonded to the exposed end of the support member, which is typically formed of tungsten carbide.

As PDC bits were being developed for use in harder formations, their cutting structures were, in many instances, designed so as to be "heavy set," which means that the bit was provided with a large number of cutter elements distributed about the face of the bit such that each of the elements would remove a comparatively small amount of material from the formation during each revolution and would be subjected to a loading that was less than the loading that would be experienced by the cutter elements if fewer cutter elements were provided. This arrangement is to be contrasted with a "light set" bit which had proven successful in softer formations and which has comparatively fewer but larger sized cutter elements, each of which would remove a greater volume of formation material than the elements used in a "heavy set" bit.

Because of the difference in design and construction of the heavy set and light set PDC bits, inefficiencies resulted when using one of these bit designs to drill through formations of differing hardness. For example, if a heavy set bit was used for the reason that a lower formation layer had a relatively high degree of hardness compared to a softer upper layer, the heavy set bit tended to clog in the softer formations, resulting in a reduced ROP in that section of the borehole. Alternatively, if a light set bit was used, the ROP in the hard formation was relatively slow in comparison to the rate that could be achieved using a heavy set bit. Thus, where PDC bits were to be used, it was frequently necessary to accept lower ROP's while drilling through formations of one degree of hardness or another, or to trip the drill string and change the drill bits when drilling through formations of differing hardness. Either of these alternatives could be extremely costly.

A common arrangement of the PDC cutting elements was at one time to place them in a spiral configuration. More specifically, the cutter elements were placed at selected radial positions with respect to the central axis of the bit, with each element being placed at a more remote radial position than the preceding element. So positioned, the path of all but the center-most elements partly overlapped the path of movement of a preceding cutter element as the bit was rotated. Thus, each element would remove a lesser volume of material than would be the case if it were radially positioned so that no overlapping occurred, or occurred to a lesser extent, because the leading cutter element would already have removed some formation material from the path traveled by the following cutter element. Using this arrangement, each cutter tended to remove a comparatively small amount of material from the formation during each revolution, and was subjected to substantially the same loading as the other cutter elements on the bit face.

Although the spiral arrangement was once widely employed, this arrangement of cutter elements was found to wear in a manner to cause the bit to assume a cutting profile presenting a relatively flat and single continuous cutting edge from one element to the next. Not only did this decrease the ROP that the bit could provide, it but also increased the likelihood of bit vibration. Both of these conditions are undesirable. A low ROP increases drilling time and cost and may necessitate a costly trip of the drill string in order to replace the dull bit with a new bit. Excessive bit vibration will itself dull or damage the bit to the extent that a premature trip of the drill string becomes necessary.

Thus, in addition to providing a bit capable of drilling effectively at desirable ROP's through a variety of formation hardnesses, preventing bit vibration and maintaining stability of PDC bits has long been a desirable goal, but one which has not always been achieved. Bit vibration typically may occur in any type of formation, but is most detrimental in the harder formations. As described above, the cutter elements in many prior art PDC bits were positioned in a spiral relationship which, as drilling progressed, wore in a manner which caused the ROP to decrease and which also increased the likelihood of bit vibration.

There have been a number of designs proposed for PDC cutting structures that are meant to provide a PDC bit capable of drilling through a variety of formation hardnesses at effective ROP's and with acceptable bit life or durability. For example, U.S. Pat. No. 5,033,560 (Sawyer et al.) describes a PDC bit having mixed sizes of PDC cutter elements with larger cutter elements positioned near the central axis of the bit and cutters of decreasing diameter at positions more distant from the central axis. This arrangement was intended to provide improved ROP while maintaining bit durability, but because the bit tends to wear in a pattern producing a relatively smooth cutting profile, the bit tends to be unstable, particularly in hard rock formations. Similarly, U.S. Pat. No. 5,222,566 (Taylor et at.) describes a drill bit which employs PDC cutter elements of differing sizes, with the larger size elements employed in a first group of cutters disposed on a first blade and smaller size cutters employed in a second group on a second blade. This bit also presents a relatively smooth cutting profile to the formation which limits the bit's ability to resist vibration. This design also suffers from the fact that the bit blades do not share the cutting load equally. Instead, the blade on which the larger sized cutters are mounted is loaded to a greater degree than the blade with the smaller cutter elements. This could lead to blade failure. U.S. Pat. No. Re. 33,757 (Weaver) describes a bit with an arrangement of blunt and scribe shaped cutters wherein the scribe cutters located directly before and between blunt cutting elements. The scribe cutters are intended to prefracture formation material and leave a series of kerfs. Following the scribe cutters are a series of blunt cutters intended to dislodge formation from between the kerfs. While this design was intended to enhance drilling performance in formations classified as medium-soft to medium, this bit includes no features directed toward stabilizing the bit once wear has commenced. Further, the bit's cutting structure has been found to limit the bit's application to relatively brittle formations.

Separately, other attempts have been made to design bits that will minimize or prevent bit vibration. For example, U.S. Pat. No. Re. 34,435 (Warren et al.) describes a bit having a set of cutters which are disposed at an equal radius from the center of the bit and which extend further from the bit face than the other cutters on the bit. According to Warren, the set of cutters extending furthest from the bit face are provided so as to cut a circular groove within the formation. In this design, the extending cutters are meant to ride in the groove in order to stabilize the bit. Similarly, U.S. Pat. No. 5,265,685 (Keith et al.) discloses a PDC bit that is designed to cut a series of grooves in the formation such that the resulting ridges that are formed between the concentric grooves will tend to stabilize the bit. U.S. Pat. No. 5,238,075 (Keith et at.) describes a PDC bit having a cutter element arrangement intended to provide stabilization which employs cutter elements of different sizes. However, the design taught in the '075 patent discloses mounting the smaller cutter elements such that, in rotated profile, their cutting profiles fall entirely within the cutting profiles of larger elements. This arrangement requires that a relatively large number of large cutter elements be positioned on the bit face. This limits the number of cutter elements that can be mounted on the bit face and, in turn, decreases the total surface area of diamond material available for cutting the formation material.

Additionally, many of these designs aimed at minimizing bit vibration required that drilling be conducted with an increased weight-on-bit (WOB) as compared with bits of earlier designs. Increasing the WOB is accomplished by adding additional heavy drill collars to the drill string in order to provide acceptable penetration rates. However, drilling with an increased or heavy WOB has serious consequences and is avoided whenever possible. The additional weight increases the stress and strain on all drill string components, causes stabilizers to wear more quickly and to work less efficiently, and increases the hydraulic pressure drop in the drill string, requiring the use of higher capacity (and typically higher cost) pumps for circulating the drilling fluid.

Thus, despite attempts and certain advances made in the art, there remains a need for a PDC bit having an improved cutter arrangement which will permit the bit to drill effectively at economical ROP's, and that will provide an increased measure of stability, both initially and as wear occurs. More specifically, there is a need for a PDC bit which can drill in soft, medium, medium hard and even in some hard formations while maintaining an aggressive cutter profile so as to maintain good ROP's for acceptable lengths of time and thereby lower the drilling costs presently experienced in the industry. Ideally, such a bit would provide an increased measure of stability so as to resist bit vibration without having to employ substantial additional WOB.

SUMMARY OF THE INVENTION

Accordingly, there is provided herein a drill bit and cutting structure particularly suited for drilling through a variety of formation hardnesses at improved penetration rates. Using normal WOB, the bit and cutting structure provide enhanced stability, both when the bit is initially placed in service and after substantial wear has occurred. The bit combines the shearing efficiency of relatively large cutter elements with the prefracturing that may be provided by smaller cutters in some formations.

The bit generally includes a cutting structure having spaced apart sets of cutter elements mounted on the bit face. The cutter elements in each set are likewise spaced apart along the bit face. A cutter set includes a plurality of cutter elements, at least two of which have cutting faces with different curvatures. In embodiments having generally circular cutting faces, the cutting faces of the cutter elements within the set will have different diameters. The large and small cutter elements in a set are mounted with overlapping profiles when viewed in a rotated profile. Larger diameter cutter elements cut a wider kerf having a larger arc while smaller diameter cutters create narrower kerfs with a smaller arc. The positioning of a large and small cutter elements with overlapping profiles creates stabilizing ridges that are larger than those that would be formed if identically-sized cutters were employed. The overlapping cutting profiles of elements in a set create regions of multiple diamond density that are better able to resist wear than regions that do not overlap the cutting profiles of radially-adjacent cutter elements. With cutter elements having generally circular cutting faces, these regions of multiple diamond density form relatively sharp, elongate cutting profiles. After the bit wears, these regions create a secondary pattern of kerfs and ridges in the formation material so as to provide enhanced bit stability even after substantial wear has occurred to the bit's cutting structure.

Additional advantages accrue through the use of different sized cutter elements. For example, the smaller diameter cutter elements direct more force downward into the formation material and may thereby prefracture the formation material. The consequent weakening of the formation allows the larger cutters to more efficiently cut through the formation, and generally allows the bit to drill through harder formation materials than would otherwise be possible. In softer formations the large diameter cutters more efficiently remove soft formation material than the smaller cutters. Thus, the bit is especially effective when used to drill through a series of successive layers of differing formation hardness.

The cutter elements in a set may have two, three or more different diameters depending upon the formation material to be drilled. One or a plurality of relatively small cutter elements may be disposed between the larger cutter elements, as viewed in rotated profile. Further, the size of the stabilizing kerfs and ridges formed in the formation material can be altered by varying the exposure height of the small or large cutter elements.

Thus, the present invention comprises a combination of features and advantages which enable it to substantially advance the drill bit art by providing a cutting structure and drill bit for effectively and efficiently drilling through a variety of formation hardnesses at economic rates of penetration. The bit provides an enhanced measure of bit stability, both before and after substantial wear has occurred to the cutting structure of the bit. Stability of the bit does not depend upon providing additional or excessive WOB. Employing the relatively small cutter elements allows the bit to be made relatively heavy set. Also, in certain formations, the smaller cutter elements of the bit prefracture the formation material, allowing the larger cutter elements to efficiently remove the material. These and various other characteristics and advantages of the present invention will be readily apparent to those skilled in the art upon reading the following detailed description of the preferred embodiments of the invention, and by referring to the accompanying drawings.

BRIEF DESCRIPTION OF THE DRAWINGS

For a detailed description of the preferred embodiment of the invention, reference will now be made to the accompanying drawings, wherein.

DESCRIPTION OF THE PREFERRED EMBODIMENT

Figure 1:
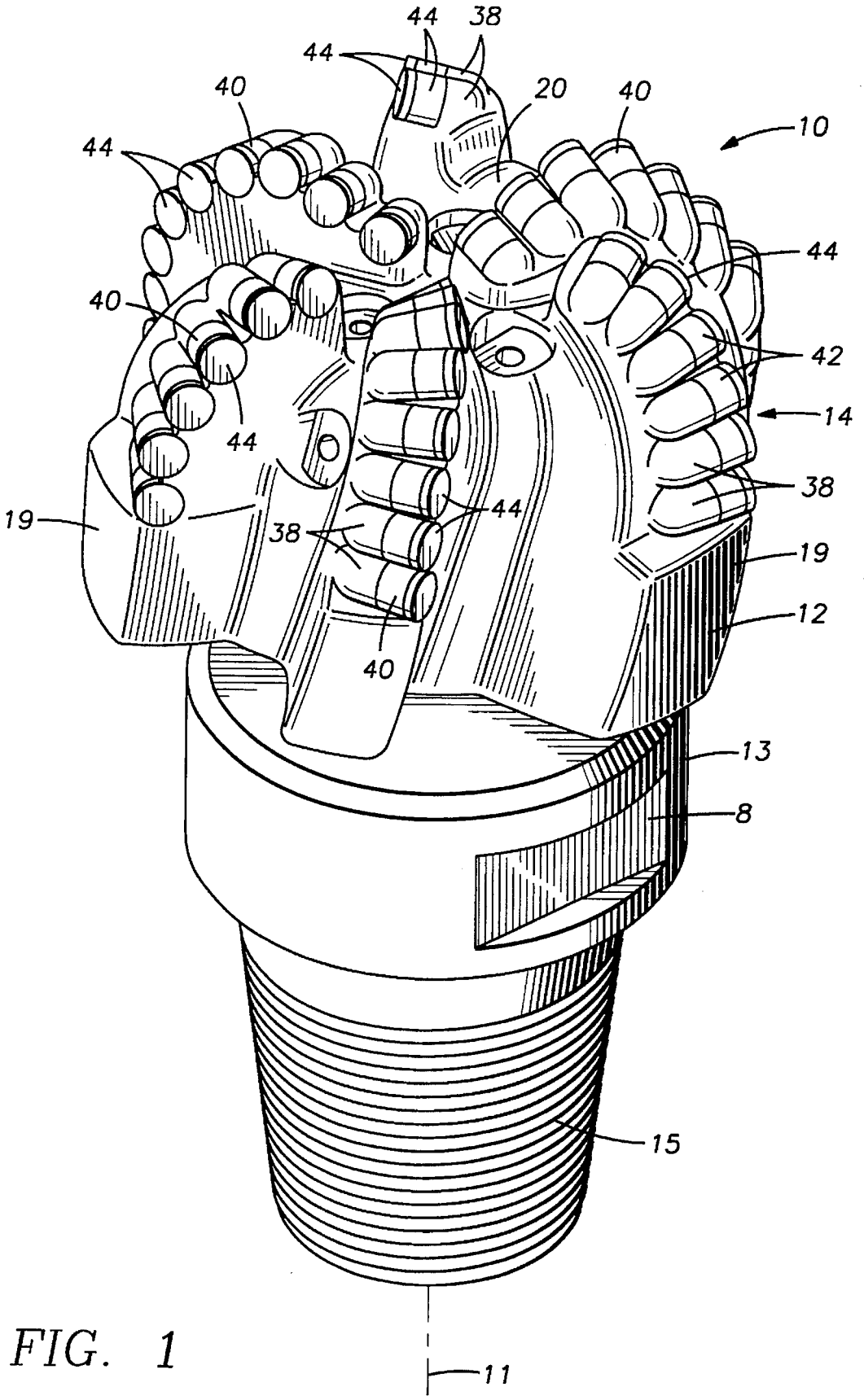
FIG. 1 is a perspective view of a drill bit and cutting structure made in accordance with the present invention.
Figure 2:
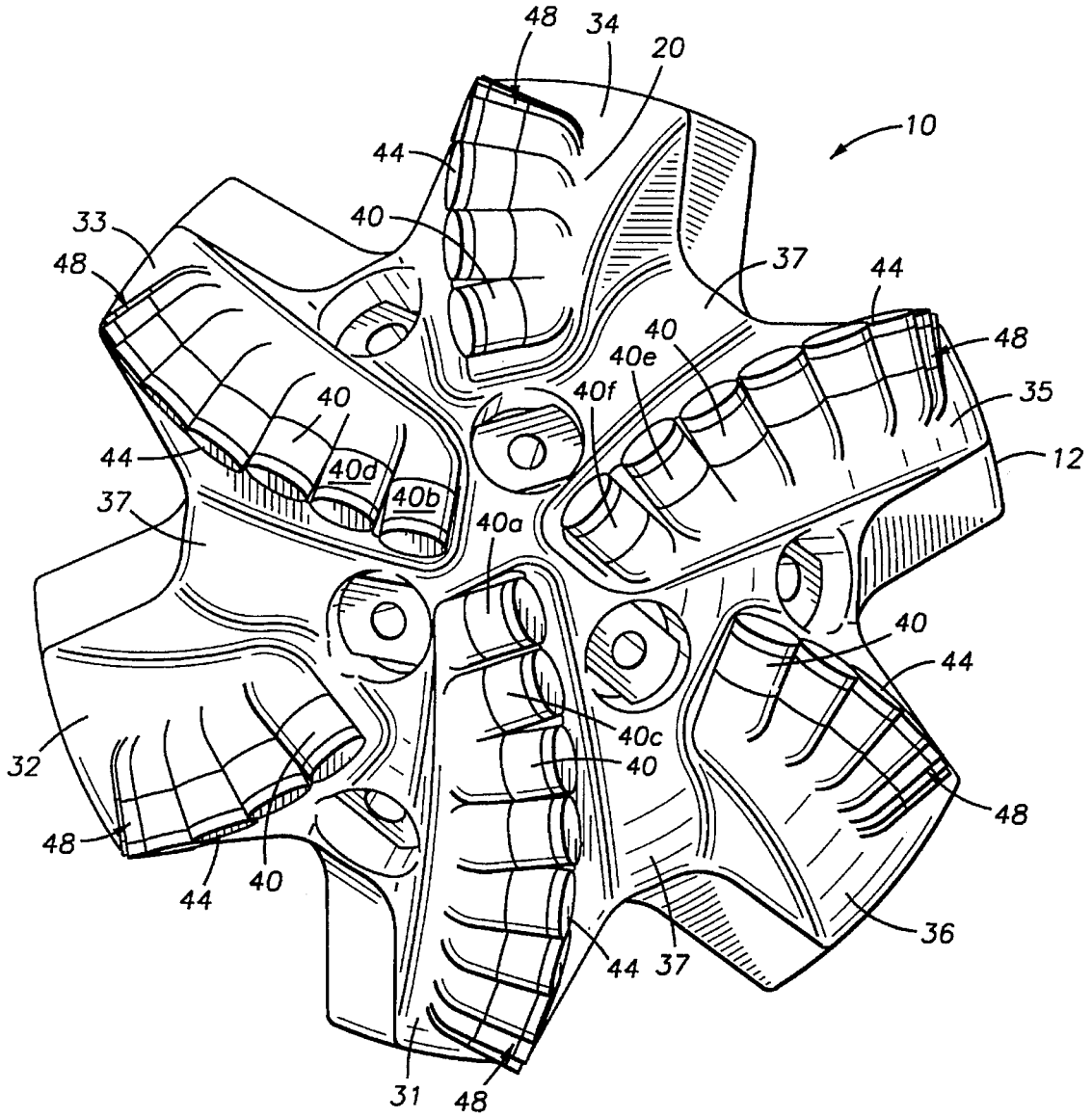
FIG. 2 is a plan view of the cutting end of the drill bit shown in FIG. 1.
Figure 3:
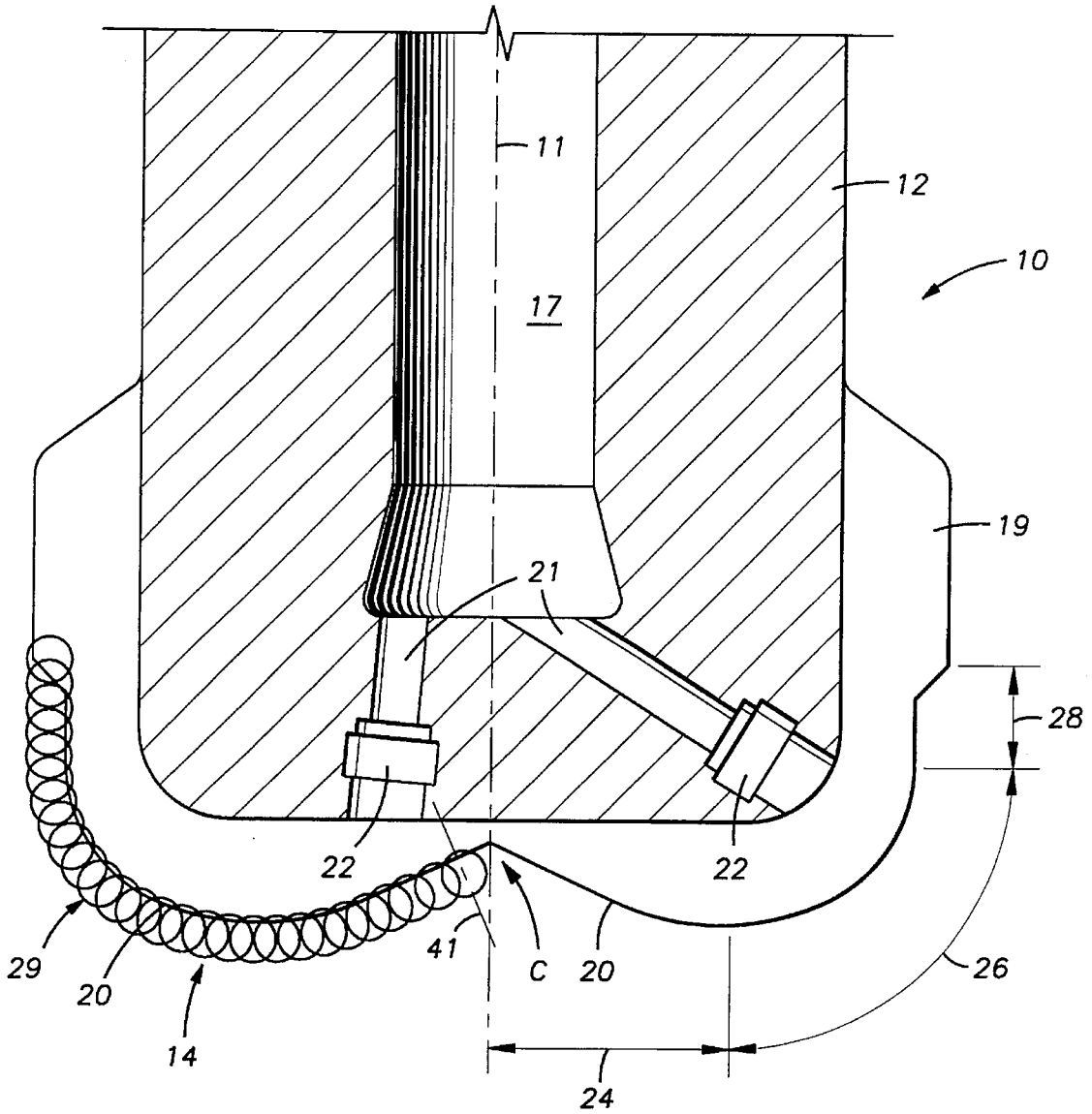
FIG. 3 is an elevational view, partly in cross-section, of the drill bit shown in FIG. 1 with the cutter elements shown in rotated profile collectively on one side of the central axis of the drill bit.

A drill bit 10 embodying the features of the present invention is shown in FIGS. 1–3. Bit 10 is a fixed cutter bit, sometimes referred to as a drag bit, and is adapted for drilling through formations of rock to form a borehole. Bit 10 generally includes a bit body 12, shank 13, and threaded connection or pin 15 for connecting bit 10 to a drill string (not shown) which is employed to rotate the bit for drilling the borehole. Bit 10 further includes a central axis 11 and a cutting structure 14 preferably including PDC cutter elements 40 of various sizes.

Bit body 12 includes a central longitudinal bore 17 (FIG. 3) for permitting drilling fluid to flow from the drill string into the bit. A pair of oppositely positioned wrench flats 8 (one shown in FIG. 1) are formed on the shank 13 and are adapted for fitting a wrench to the bit to apply torque when connecting and disconnecting bit 10 from the drill string.

Bit body 12 further includes gage pads 19 and a bit face 20 which is formed on the end of the bit 10 that is opposite pin 15 and which supports cutting structure 14, described in more detail below. As best shown in FIG. 3, bit axis 11 passes through the center C of bit face 20. Body 12 is formed in a conventional manner using powdered metal tungsten carbide particles in a binder material to form a hard metal cast matrix. Steel bodied bits, those machined from a steel block rather than a formed matrix, may also be employed in the invention. In the preferred embodiment shown, bit face 20 includes six angularly spaced-apart blades 31–36 (FIG. 2) which are integrally formed as part of and which extend from body 12. Blades 31–36 generally extend radially across the bit face 20 and longitudinally along a portion of the periphery of the bit, beginning near center C of bit face 20 and extending to gage pad 19. Blades 31–36 support cutter elements 40 and are separated by grooves which define drilling fluid flow courses 37 between and along the cutting faces 44 of the cutter elements 40. Again, in the embodiment shown in FIG. 2, blades 31, 33 and 35 are equally spaced approximately 120° apart, while blades 32, 34 and 36 lag behind blades 31, 33 and 35 by about 55°. Given this angular spacing, blades 31–36 may be considered to be divided into pairs of "leading" and "lagging" blades, a first such blade pair comprising blades 31 and 32, a second pair comprising blades 33 and 34, and a third pair including blades 35 and 36.

As best shown in FIG. 3, body 12 is also provided with downwardly extending flow passages 21 having nozzles 22 disposed at their lowermost ends. In the preferred embodiment of FIGS. 1–3, bit 10 includes six such flow passages 21 and nozzles 22. The flow passages 21 open into central bore 17. Together, passages 21 and nozzles 22 serve to distribute drilling fluids around the cutter elements 40 for flushing formation cuttings from the bottom of the borehole and away from the cutting faces 44 of cutter elements 40 when drilling.

Referring still to FIG. 3, to aid in the understanding of the more detailed description which follows, cutting structure 14 and bit face 20 may be said to be divided into three different portions or regions 24, 26 and 28. The central portion of the bit face 20 is identified by the reference numeral 24 and may be concave as shown. Adjacent to central portion 24 is the shoulder or the upturned curved portion 26. Next to shoulder portion 26 is gage portion 28, which defines the diameter or gage of the borehole drilled by bit 10. As will be understood by those skilled in the art, regions 24, 26 and 28 are approximate and are identified only for the purposes of better describing the distribution of cutter elements 40 over the cutting structure 14 and bit face 20. FIG. 3 depicts the cutter elements 40 of the bit 10 in rotated profile collectively on one side of central bit axis 11. As will be apparent from the description that follows, the invention contemplates the use of cutter elements 40 having different sizes or curvatures. The differences in the curvature and size of the cutting faces 44 of the various cutter elements 40 is not visible in FIGS. 1–3, but is described in more detail below with reference to FIGS. 4–10.

As best shown in FIGS. 1 and 2, molded into each blade of bit 10 are a series of cutter pockets 38 for mounting cutter elements 40. Cutter elements 40 are constructed by conventional methods and each typically includes a base or support member 42 having one end secured within cutter pocket 38 by brazing or similar means. The support 42 is comprised of a sintered tungsten carbide material having a hardness greater than that of the body matrix material of bit body 12. Attached to the opposite end of the support member 42 is a layer of extremely hard material, preferably a synthetic polycrystalline diamond material which forms the cutting face 44 of element 40. Such cutter elements 40, generally known as polycrystalline diamond composite compacts, or PDC's, are commercially available from a number of suppliers including, for example, Smith Sii Megadiamond, Inc., General Electric Company or DeBeers Industrial Diamond Division. Although cutters 40 have thus far been shown and described as generally cylindrical elements, the bit 10 and cutting structure 14 of the present invention is not limited to any particular type of cutter element, and stud-type cutters which have cutting faces 44 mounted on posts or studs that are fixed normal to the bit face may also be employed.

As shown in FIGS. 1 and 2, the cutter elements 40 are arranged in separate rows 48 along the blades 31–36 and are positioned along the bit face 20 in the regions previously described as the central portion 24, shoulder 26 and gage portion 28. Cutter elements 40 of rows 48 are mounted on blades 31–36 in predetermined radially-spaced positions relative to the central axis 11 of the bit 10. The cutting faces 44 of the cutter elements 40 are oriented in the direction of rotation of the drill bit 10 so that the cutting face 44 of each cutter element 40 engages the earth formation as the bit 10 is rotated and forced downwardly through the formation. Cutter elements 40 in rows 48 are radially spaced in rows 48 such that the groove or kerf cut in the formation material by the cutting face 44 of a cutter element 40 will overlap to a degree with kerfs formed by cutter elements of other rows 48. In this manner, as bit 10 is rotated, cutter elements 40 in the row 48 of blade 31, for example, will cut separate kerfs in the formation material, leaving ridges of formation material between those kerfs. As the bit 10 continues to rotate, various cutter elements 40 that are mounted on blades 32–36 will cut the formation material that is left between the kerfs formed by the cutter elements 40 of blade 31. With this radial overlap of cutter 40 profiles, the cutting profile of cutting structure 14 may be generally represented by the scalloped curve 29 shown in FIG. 3 which is formed by the outer-most edges of cutting faces 44 of cutters 40. It is to be understood, however, that a principle of the present invention is to provide a bit face 20 with cutting structure 14 that will provide enhanced bit stability, both initially and after wear has occurred. This is accomplished by properly sizing and positioning cutter elements 40 so that they will create stability-enhancing ridges of formation material when the bit is rotated. Thus, although bit cutting profile 29 appears in FIG. 3 to be relatively smooth or only slightly scalloped, the stabilizing ridges and the relative size and placement of cutter elements 40 that create the ridges is better depicted in FIGS. 4–10 and described in the accompanying text.

In addition to being mounted in rows 48, cutter elements 40 are also arranged in sets 50, each set 50 including cutter elements 40 from various rows 48. Each set 50 includes at least three radially-spaced cutter elements, at least two of which have cutting faces 44 with differing curvatures. When employing cutters having substantially circular cutting faces, this arrangement is achieved by choosing cutters 40 having cutting faces of differing diameters. The precise radial positioning and differences in diameter of the cutter elements 40 in the sets 50 are not visible in FIG. 3, but are described in more detail below with reference to FIGS. 4–10.

Figure 4:
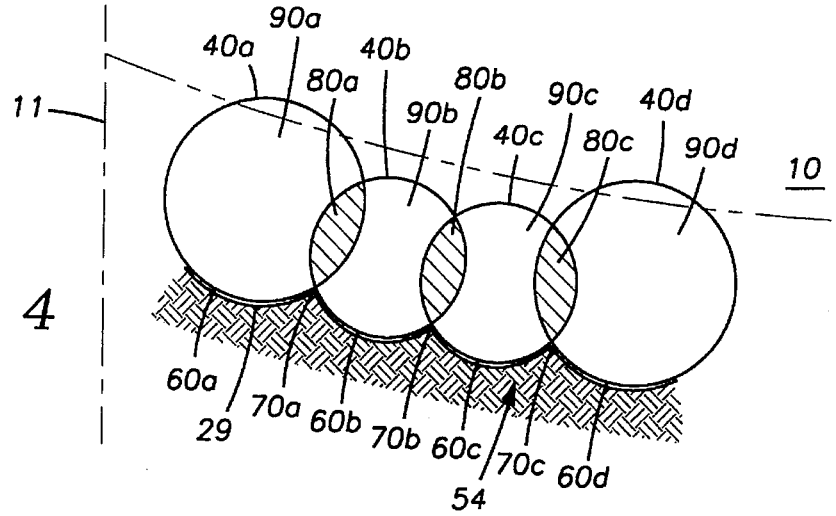
FIG. 4 is an enlarged view of a portion of FIG. 3 showing, in rotated profile, the cutting profile of a set of cutter elements.

Cutter sets 50 are best understood with reference first to FIG. 4 which schematically shows, in rotated profile, the relative radial positions and sizes of the most centrally located cutter elements **40*a*–40*d* of a cutter set 50A. Referring momentarily to FIG. 2, elements 40*a*–40*d* are shown as comprising those cutter elements 40 that are positioned closest to bit axis 11. As shown in FIG. 2, elements 40*a*, 40*c* are radially spaced from one another and are mounted in a first row 48 on blade 31, while cutter elements 40*b*, 40*d* are radially spaced from one another along a second row on blade 33. Cutter elements 40*a*–40*d* and their respective cutting faces 44 have different diameters and cutting profiles. Preferably, cutter elements 40*a*, 40*d* have cutting faces 44 which are larger in diameter than cutter elements 40*b*, 40*c*. It is preferred that the cutting faces of elements 40*a* and 40*d* be approximately 0.75 inches in diameter and that the smaller diameter cutters 40*b*, 40*c* have diameters of about 0.5 inches. Other sizes of cutting faces 44 may be employed. For example, cutter elements 40*a*, 40*d* may have cutting faces larger than 0.75 inches diameter, and, for example, may be one inch in diameter. In such instance, cutter elements 40***b*, 40*c* may have cutting faces 44 that are 0.75 or 0.5 inches in diameter, as examples. As explained in more detail below, what is important to the present invention is that there be a difference in the curvature between the cutting faces of cutter elements 40 within a set 50.

Cutter elements 40 in sets 50 are radially spaced such that each cutter 40 has a cutting profile that partially overlaps the cutting profile of adjacent cutter elements 40 in the same set 50. The degree or extent of overlap of cutting profiles of elements 40 in sets 50 may be varied within each set, and may also vary from set to set across the bit face 20. As shown in FIG. 4, the common areas of intersection of the overlapping element cutting profiles form elongate-shaped regions 80 of double diamond density as the bit is rotated in the borehole. Region 80*a* is defined by the overlapping cutting profiles of cutter elements 40*a* and 40*b*, and region 80*b* is defined by the overlap in cutting profiles of cutter elements 40*b* and 40*c*. Likewise, region 80*c* is formed by the overlap in cutting profiles of elements 40*c* and 40*d*. On each side of a region 80 are regions 90 having single diamond density. As the cutter elements 40*a*–40*d* wear, the regions 90 of single diamond density wear relatively quickly compared to regions 80 of double diamond density. The variable wear patterns of set 50A and their benefits are described in more detail below with reference to FIG. 6.

It is desirable to divide the large and small diameter cutter elements 40 in a set 50 among different blades 31–36. More specifically, and referring still to FIGS. 2 and 4, the large and small diameter cutters 40*a*–40*d* of set 50A are divided such that large diameter cutter element 40*a* and small diameter cutter element 40*c* are mounted on the same blade 31. Likewise, large diameter cutter element 40*d* and small diameter cutter element 40*b* are mounted on blade 33. Although the invention is depicted in FIGS. 1 and 2 on a six-bladed bit 10, the principles of the present invention can be employed in bits having any number of blades, and the invention is not limited to a bit having any particular number of blades or angular spacing of the blades.

Employing the cutter arrangement of the present invention, including the presently preferred embodiment, shown in FIG. 4, provides enhanced bit stability, both before and after wear has occurred. Referring still to FIGS. 1, 2 and 4, as the bit 10 is rotated about its axis 11, the blades 31–36 sweep around the bottom of the borehole causing the cutter elements 40 to cut concentric troughs or kerfs within the formation material 54. More specifically, as blade 31 traverses the formation, elements 40*a*, 40*c* cut differing sized kerfs (60*a*, 60*c* respectively) in the formation leaving uncut formation material between the kerfs. As bit 10 continues to rotate, these uncut areas are removed by cutter elements 40 on other blades 31–36, including specifically, by cutting elements 40*b*, 40*d* on blade 33 which themselves cut kerfs 60*b*, 60*d*. After one complete rotation of the bit, kerfs 60*a*–*d* will have been formed in the formation material. Between kerfs 60*a*–*d* are well defined ridges 70. Ridge 70*a* will remain between kerfs 60*a* and 60*b* after a rotation of bit 10. Likewise, ridge 70*b* will remain between kerfs 60*b* and 60*c*, and ridge 70*c* will separate kerfs 60*c* and 60*d*.

The cutter arrangement shown in FIG. 4, which includes the positioning of a relatively small diameter cutter 40*b* (which has a relatively large curvature), radially-adjacent to a larger cutter element 40*a* (one having a smaller curvature) creams ridges 70*a* and 70*c* that are higher than the ridges that would be created if identically-sized cutter elements were radially adjacent to one another. Providing higher ridges 70*a*, 70*c* between the kerfs in turn provide for increased stabilization for the bit, as the ridges 70*a* and 70*c* will tend to make the bit highly resistant to lateral movement due to the increased side loading imparted by the ridges to the cutter elements 40*a*–40*d* of set 50A. The bit 10 will thus tend to remain stable and resist bit vibration. This advantage is best understood by referring to FIG. 5.

Figure 5:
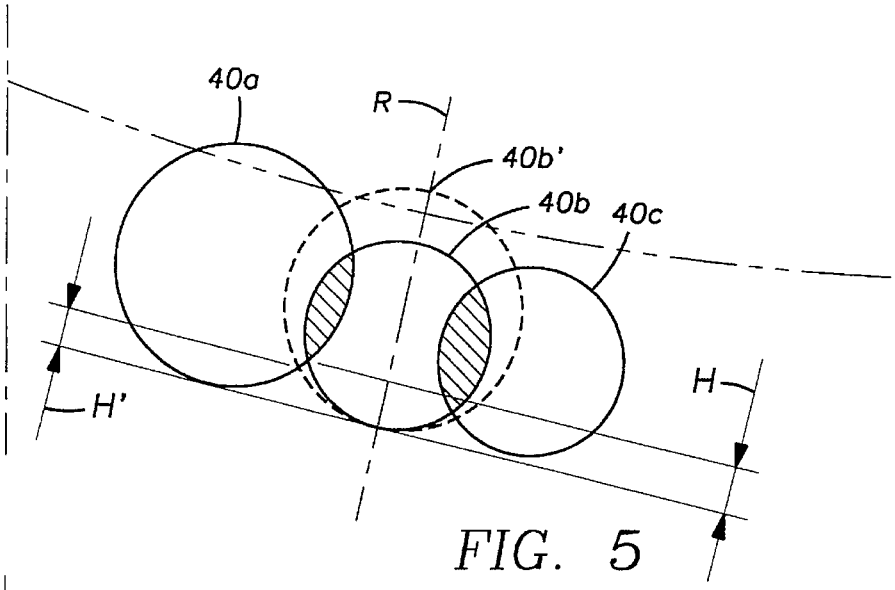
FIG. 5 is an enlarged view of a portion of the cutter element set shown in FIG. 4.

Shown in FIG. 5 are cutter elements 40*a*–40*c* of set 50A as previously described with reference to FIG. 4. Also shown in phantom by the dashed line is the cutting profile of a cutter element 40*b*′ positioned in the same radial position R as element 40*b*. Element 40*b*′, however, is shown to have a diameter equal to the diameter of element 40*a*. The height of ridge 70*a* formed by the overlap of cutter profiles of cutter elements 40*a* and 40*b* is shown to be equal to H. By contrast, if a large element 40*b*′ were to be substituted for the smaller element 40*b* in set 50A, the resulting ridge height would be H' which, as shown in FIG. 5, is less than H. Thus, using radially adjacent cutter elements 40*a* and 40*b*′ having the same diameters would therefor provide less stabilization for the bit than that provided by set 50A of the present invention which includes radially-adjacent cutter elements 40*a*, 40*b* having differing curvatures. Although the element 40*b*′ could be radially positioned such that the height H' could be made equal to H by moving the mounting position of element 40*b*′ further from element 40*a* and away from the bit axis 11, such a bit would not include as many regions of multiple diamond density, and would thus have the characteristics of a more light set bit, or at least of a bit that can not be made as "heavy set" as that provided by the present invention. More specifically, if the two smaller elements 40*b* and 40*c* of set 50A shown in FIGS. 4 and 5 were replaced in bit 10 by a single cutter element the same size as elements 40*a* and 40*d*, and if these three cutter elements were radially spaced such that their cutting profiles intersected at the stone points that the cutting profiles of element 40*a* intersects with 40*b*, and that 40*c* intersects with 40*d* as shown in FIG. 4, then the height of ridges would all be equal to H (FIG. 5); however, the region 80*b* of double diamond density would be absent from the rotated profile of the bit, thus the durability of the cutting structure 14 and bit 10 would not be as great as that of the invention shown in FIG. 4. As is apparent then, the cutter arrangement of set 50A as shown in FIG. 4 in which cutter elements having large curvatures are disposed in radially-adjacent positions to cutter elements having small curvatures provides increased ridge height for enhanced stabilization and, at the same time, provides increased durability by providing an increased number of areas of multiple diamond density.

It can be appreciated that the stabilizing effects provided by cutter set 50A can be further increased by positioning similar sets 50A across the central portion 24 and shoulder portion 26 of the present drill bits. The stabilization provided by the present invention accrues primarily in central region 24 and shoulder portion 26. Thus, cutter sets 50A may or may not be disposed on gage portion 28.

Figure 6:
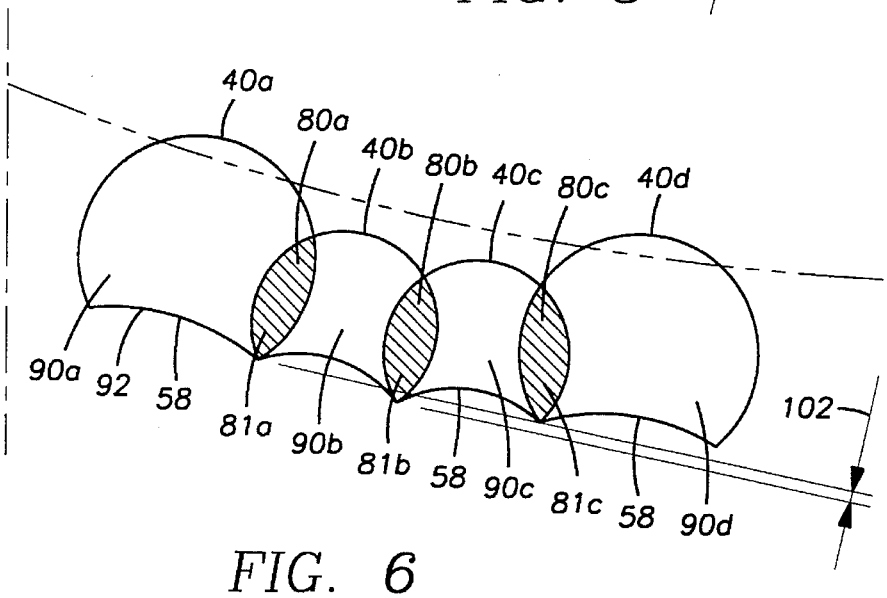
FIG. 6 is a view similar to FIG. 4 showing the cutting profile of the cutter element set shown in FIG. 4 as it exists after wear has occurred to the cutter elements.
Figure 7:
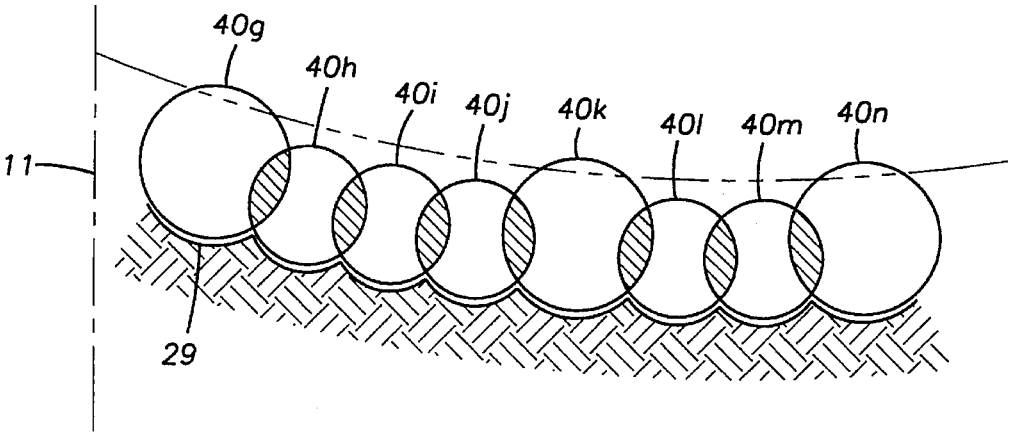
FIG. 7 is a view similar to FIG. 4 showing an alternative embodiment of the present invention.

Cutter set 50A also enhances bit stability even after substantial wear has occurred to cutting structure 14. Shown in FIG. 6 is the set cutting profile of a worn cutter set 50A such as the cutting profile might appear after drilling through a substantial amount of formation material, set 50A having a set cutting profile generally represented by the scalloped line designated by reference numeral 92. As shown, regions 80 of double diamond density tend to resist wear and thereby better retain their original cutting profiles, while the single diamond density regions 90 of cutter faces 44 are worn away to a greater degree. As wear becomes more pronounced, the regions of double diamond density 80 will present a relatively sharp and highly exposed cutting profile to the formation material as compared to the worn away single diamond density regions 90. The relatively sharp scribe shaped regions 80 will then create grooves and stabilizing ridges as the bit drills through formation material, these grooves being formed at substantially the same radial position that ridges 70*a*–70*c* shown in FIG. 4 were created.

Bit stabilization after wear has occurred to the bit cutting structure is further enhanced by the present invention due to its use of radially adjacent large and small cutter elements 40 in sets such as set 50A. Referring again to FIG. 6, by positioning smaller cutter elements 40*b*, 40*c* radially-adjacent to one another and between large cutter elements 40*a* and 40*d* (in rotated profile), the tip 81*b* of double diamond density region 80*b* (that point most exposed to the formation material) will project further into the formation than will the tips 81*a* and 81*c* of regions 80*a* and 80*c*. This arrangement thus creates stabilizing ridges of formation material between double diamond density regions 80*a* and 80*b*, and between regions 80*b* and 80*c*, the height of the ridges being at least as great as the difference between the exposure height of tip 81*b* relative to tips 81*a* or 81*c*, such difference represented by dimension arrow 102 in FIG. 6. Thus, positioning adjacent cutter elements so as to provide elongate regions 80 of multiple diamond density across the span of a set cutting profile, and across the bit face 20, helps the bit maintain an aggressive cutting structure and a high ROP, and prolongs the useful life of the bit. Simultaneously, the regions of multiple diamond density provide a stabilizing effect on the bit and lessens the likelihood of damaging bit vibration occurring as the bit wears.

The use of relatively large and small cutter elements 40*a*–40*d* in set 50A has an additional advantage over the cutter arrangements in the prior art that employed all large or all small cutter elements in the same region of the bit face 20. Due to their relatively close positioning to one another, the large and small cutter elements 40*a* and 40*b*, for example, will apply substantially the same force to the formation; however, due to the difference in the elements'curvature, the forces applied through the smaller cutter 40*b* will be more concentrated or directed. This is because the resultant vector of forces applied to the formation are concentrated in a smaller arcuate area of the cutter element 40*b* compared to the larger element 40*a*. In certain types of formations, this allows the smaller cutter elements 40*b*, 40*c* to prefracture the formation material, allowing the larger cutter elements 40*a*, 40*d* to remove the prefractured material more easily and with less wear than would otherwise be the case if no prefracturing occurred. This, in turn, decreases the drilling torque required to drill the borehole.

In contrast to the present invention, if, instead of using smaller elements 40*b*, 40*c*, another or additional large diameter elements were used, the forces applied through the larger cutters may not be concentrated enough to provide for the desirable prefracturing. Alternatively, if only small cutter elements were employed in a particular region of the bit, so as to apply the more concentrated forces to the formation, the bit would lack the substantial benefits provided by large diameter cutters, those benefits including the increased or enhanced shearing capabilities which are desirable in certain formations. Thus, the invention combines the high shearing efficiency provided by large cutters with the high penetration forces provide by smaller cutters. Further, providing smaller cutter elements on the bit face lowers the cost to manufacture the bit as compared to a similar bit that employs all large cutters because it is less expensive to manufacture smaller cutter elements than larger ones. Thus, the cutter arrangement shown in FIG. 4 provides certain of the advantages that small and large cutter elements provide individually, as well as the added benefits that have been described above that result from the combination of large and small elements in radially adjacent positions.

Referring again to FIG. 4, it is preferred that cutter set 50A include other cutter elements 40 that have the same cutting profiles as some or all of the elements 40*a*–40*d*. Such cutter elements are mounted on the bit face 20 at substantially the same radial position as elements 40*a*–40*d*, but are positioned in blades other than 31 and 33. So positioned, these elements therefore follow in the same swath or kerf cut by a preceding cutter element 40 of set 50A. As used herein, such elements may be referred to as "redundant" cutters. Redundant cutters increase the durability and life of the bit 10 by increasing the diamond density, and thus ensure that well defined stabilizing grooves are formed in the formation material. In the rotated profile of FIGS. 3–6, the distinction between such redundant cutter elements cannot be seen; however, the arrangement may be understood with reference to FIG. 2 where cutter element 40*e* and 40*f* are positioned on bit face 20 so as to be redundant to cutters 40*a* and 40*c*, respectively. In this arrangement, and referring to FIG. 4, regions of multiple diamond density 80 would have triple diamond density. Redundant cutters may be employed for any cutter dement 40 in any set 50, and are of greatest benefit when located at radial positions on the bit face that are subjected to particularly severe loading, such as at locations in the central portion 24 or shoulder portions 26 of bit face 20.

Certain variations or alternative embodiments to the drill bit and cutter arrangement previously described are shown in FIGS. 7–10. In describing these embodiments, similar reference numerals and characters will be used to identify like or common elements.

Although set 50A has thus far been depicted and described as including radially spaced cutter elements 40*a*–40*d* (and redundant cutter element 40*e*, 40*f*), the invention is not limited to having a particular number of cutter elements 40 in a set 50. That is, a set 50 may include three, four or any larger number of radially-spaced elements 40, and may also include any desirable number of redundant elements. Further, the invention is not limited to any particular ratio of large cutter elements to small elements within a set 50. For example, and referring now to FIG. 7, there is shown radially-adjacent cutter element sets 50B and 50C. Cutter element set 50B includes five cutter elements 40*g*–40*k*, while 50C includes four cutter elements 40*k*–40*n*. In this embodiment, cutter element 40*k* is a member of both sets 50B and 50C. Cutter elements 40*h*–40*j* and 40*l*–40*m* have cutting faces with relatively small diameters in comparison to cutter elements 40*g*, 40*k*, 40*n*, such that the ridges that are formed in the formation material by sets 50B and 50C will be higher (and thus will provide greater stabilization to the bit) than would be the case if cutter elements having the same size as elements 40*g*, 40*k*, 40*n* were disposed between elements 40*g* and 40*k* and between 40*k* and 40*n*.

Figure 8:
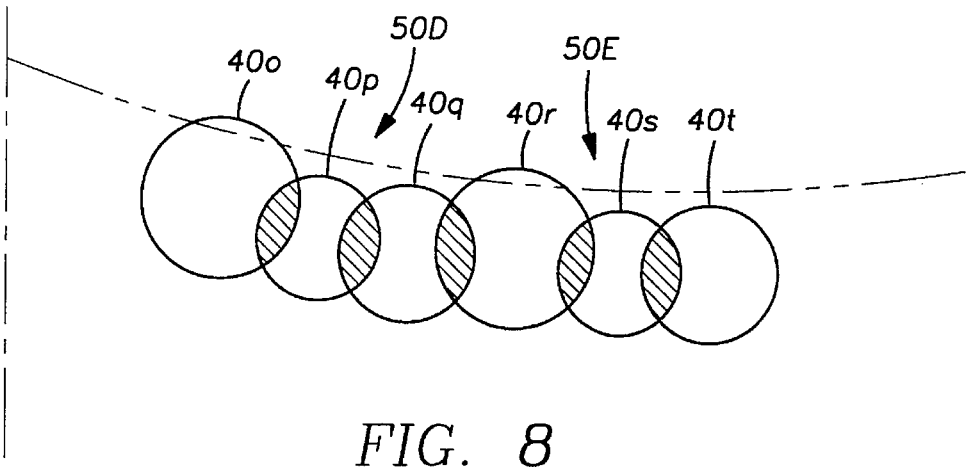
FIGS. 8–10 are views similar to FIG. 4 and show further alternative embodiments of the present invention.
Figure 9:
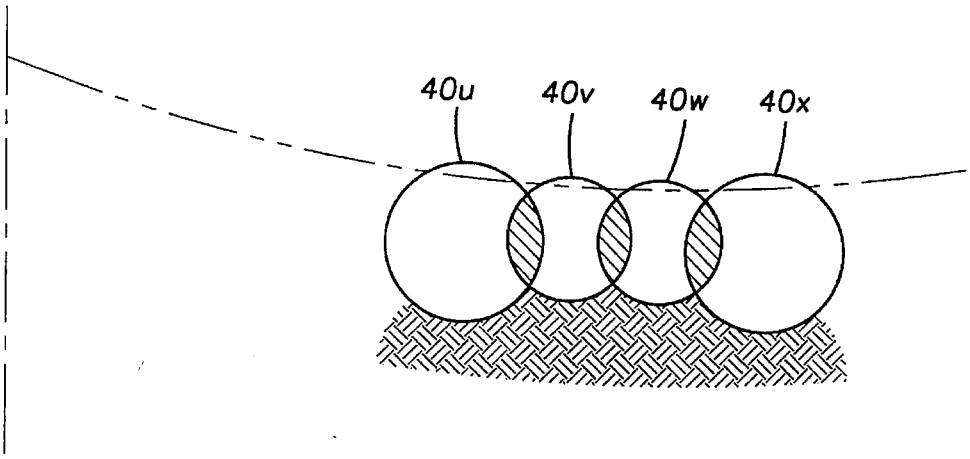

Another alterative embodiment of the invention is shown in FIG. 8 which shows a cutting structure 14 having two cutter element sets 50D and 50E, each of which includes three radially-spaced cutter elements. As shown, cutter element sets 50D and 50E each include three cutter elements having generally circular cutting faces of differing diameters. More specifically, cutter element set 50D includes elements 40*o*–40*q* and set 50E includes elements 40*r*–40*t*. Each set 50D and 50E preferably includes redundant cutter elements (not shown). Cutter elements 40*o*, 40*r* have relatively large diameters, as is advantageous for efficient shearing when drilling, and may be 0.75 inch in diameter, for example. Elements 40*p*, 40*s* are chosen to have smaller cutting faces and, for example, may be 0.5 inch in diameter. Elements 40*p* and 40*s* are mounted such that, in rotated profile, their cutting profiles overlap with the cutting profiles of elements 40*o* and 40*t*, respectively. Cutter elements 40*q* and 40*t* have cutting faces that are larger than those of cutters 40*p* and 40*s*, but are smaller than those of elements 40*o* and 40*r* and, for example, may have diameters equal to 0.625 inch. Elements 40*q* and 40*t* are radially spaced such that in rotated profile, their cutting profiles will overlap with the cutting profiles of cutter elements 40*p* and 40*s*, respectively. With this arrangement, the highest stabilizing ridges will be formed between elements 40*o* and 40*p* and between elements 40*r* and 40*s* due to the more extreme difference in curvature of these pairs of elements than between elements 40*p* and 40*q* and between 40*s* and 40*t*. A cutting structure 14 such as that shown in FIG. 8 may be preferred over that shown in FIG. 4 for drilling in softer formations where more shearing is desired and where prefracturing is not especially advantageous.

To further enhance stabilization of the bit 10, the exposure height of the elements 40 within a set can be varied. For example, referring to FIG. 9, a cutter set 50F is shown comprising cutter elements 40*u*–40*x*. Cutter elements 40*v* and 40*w* are smaller than cutter elements 40*u* and 40*x* and thus have cutting faces with larger curvature than the larger elements 40*u* and 40*x*. As previously explained with reference to FIGS. 4 and 5, this arrangement alone provides an enhancement in stabilization. In set 50F, however, elements 40*u* and 40*x* are mounted on the bit face so as to be more exposed to the formation material than smaller elements 40*v* and 40*w*. As compared to cutter set 50A shown in FIG. 4, where all the cutter elements were mounted at substantially the same exposure height, the cutter arrangement of set 50F increases the size of the stabilizing ridges 70*a* and 70*c* that are formed as the bit is rotated, and thus provides for enhanced stabilization for the unworn bit.

Figure 10:
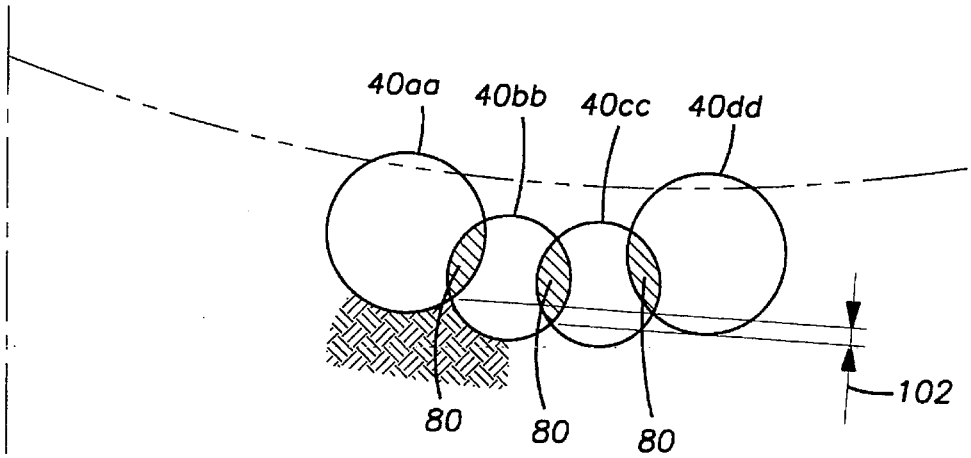

An increased measure of stabilization for a partially worn bit can also be achieved using the principles of the present invention. Referring to FIG. 10, cutter element set 50G is shown having relatively small diameter cutter elements 40*bb* and 40*cc* mounted so as to be more exposed to the formation material than the larger cutter elements 40*aa* and 40*dd* which flank elements 40*bb*, 40*cc* in rotated profile. Employing this arrangement, the stabilizing ridges 70*a* and 70*c* that are initially formed when the unworn bit is rotated will be smaller than those formed by set 50A of FIG. 4; however, after the bit has become partially worn, the difference in exposure height as between tips 81*b* and 81*a* (and between 81*b* and 81*c*) of multiple diamond density regions 80 as designated by reference numeral 102 will be even greater than that shown in FIG. 6 for set 50A. The arrangement of set 50G will thus create deeper grooves and higher stabilizing ridges after wear has occurred to the cutting structure of the bit, as compared to that of set 50A of FIG. 4.

While the preferred embodiments of the invention have been shown and described, modifications thereof can be made by one skilled in the art without departing from the spirit and teachings of the invention. The embodiments described herein are exemplary only, and are not limiting. Many variations and modifications of the invention and the principles disclosed herein are possible and are within the scope of the invention. For example, cutter elements may be positioned on the bit with back rake or forward rake. Accordingly, the scope of protection is not limited by the description set out above, but is only limited by the claims which follow, that scope including all equivalents of the subject matter of the claims.

What is claimed is:

1. A drill bit for drilling through formation material when said bit is rotated about its axis, said drill bit comprising:

a bit body including a bit face having a plurality of radially disposed blades angularly spaced from one another;

cutter elements disposed in rows on said blades and having cutting faces oriented so as to cut kerfs in the formation material when the bit is rotated about its axis, said cutter elements including a first plurality with cutting faces having a curved cutting edge of a first curvature, a second plurality with cutting faces having a curved cutting edge of a second curvature that is greater than said first curvature, and a third plurality with cutting faces having a curved cutting edge of a third curvature that is less than said second curvature, at least one of said blades having a row of cutter elements that includes cutter elements from at least two of said first, second and third pluralities;

wherein said cutter elements are arranged in sets of cutter elements on said bit face, each of said cutter elements of said sets having a cutting profile that, in rotated profile, partially overlaps with the cutting profile of at least one other cutter element of said same set;

wherein a first set includes a first cutter element of said first plurality mounted on a first blade at a first radial position relative to the bit axis, a second cutter element of said second plurality mounted on a second blade at a second radial position relative to the bit axis such that the cutting profile of said second cutter element partially overlaps in rotated profile with the cutting profile of said first cutter element, and a third cutter element of said third plurality mounted at a third radial position relative to the bit axis;

wherein said second radial position is between said first and said third radial positions.

2. The drill bit of claim 1 wherein said third cutter element of said first set is mounted such that, in rotated profile, the cutting profile of said third cutter element partially overlaps with the cutting profile of said second cutter element.

3. The drill bit of claim 1 wherein said third curvature is substantially equal to said first curvature.

4. The drill bit of claim 1 wherein said third curvature is greater than said first curvature.

5. The drill bit of claim 1 wherein said third curvature is less than said first curvature.

6. The drill bit of claim 1 wherein said first set further comprises a fourth cutter element having a cutting face with a curvature that is substantially equal to said curvature of said second cutter element, and wherein said fourth cutter element is mounted such that, in rotated profile, the cutting profile of said fourth cutter element partially overlaps with the cutting profile of said second cutter element.

7. The drill bit of claim 1 wherein each of said blades of said bit face includes a row of cutter elements that includes cutter elements from at least two of said first, second and third pluralities.

8. The drill bit of claim 4 wherein said one blade includes a row of cutter elements that includes cutter elements from all of said first, second and third pluralities.

9. The drill bit of claim 8 wherein each of said blades of said bit face includes a row of cutter elements that includes cutter elements from all of said first, second and third pluralities.

10. The drill bit of claim 1 wherein said first set further comprises a fourth cutter element having a cutting face with a curvature that is substantially equal to said curvature of said second cutter element, and wherein said fourth cutter element is mounted at a radial position that is between said second and third cutter elements when viewed in rotated profile, and wherein said third curvature is greater than said first curvature.

11. A cutting structure for a drill bit comprising:

a bit face having a central axis;

cutter elements having cutting profiles and generally circular cutting faces mounted on said bit face in radially-disposed rows, said cutter elements including a first plurality having cutting faces of a first diameter and a second plurality having cutting faces of a second diameter that is smaller than said first diameter, and a third plurality having cutting faces of a third diameter that is larger than said second diameter;

wherein a first and a second of said rows of cutter elements each includes cutter elements from said first and said second plurality, said cutter elements in each of said first and second rows being radially spaced from one another; and wherein said cutter elements are mounted on said bit face in sets of cutter elements, a first set including a first cutter element of said first plurality and a second cutter element of said second plurality mounted in separate ones of said rows of cutter elements and at different radial positions relative to said axis such that, in rotated profile, the cutting profiles of said first and said second cutter elements partially overlap and such that said first cutter element is mounted closer to said axis than said second cutter element, said first set further including a third cutter element of said third plurality mounted on said bit face at a third radial position that is further from said axis than said first and said second radial positions.

12. The cutting structure of claim 11 wherein said first set further includes a plurality of said cutter elements having cutting faces of said second diameter that are mounted on said bit face at radial positions between said second and said third radial positions.

13. The cutting structure of claim 11 wherein said third diameter is larger than said first diameter.

14. The cutting structure of claim 11 wherein said third diameter is smaller than said first diameter.

15. The cutting structure of claim 11 wherein said third diameter is substantially the same size as said first diameter.

16. The cutting structure of claim 11 wherein said rows include cutter elements of said first, second and third plurality of cutter elements.

17. A fixed cutter drill bit for drilling through formation material when said bit is rotated about its axis, said drill bit comprising:

a bit face having a plurality of radially-disposed and angularly spaced blades;

PDC cutter elements disposed in rows on said blades in radially-spaced locations and having cutting faces oriented so as to cut kerfs in the formation material when the bit is rotated about its axis, said cutter elements including a first plurality with cutting faces having a curved cutting edge of a first curvature, a second plurality with cutting faces having a curved cutting edge of a second curvature that is greater than said first curvature, and a third plurality with cutting faces having a curved cutting edge of a third curvature that is less than said second curvature, each of said blades having a row of cutter elements that includes cutter elements from at least two of said first, second and third pluralities;

at least one set of cutter elements on said bit face, each of said cutter elements of said one set having a cutting profile that, in rotated profile, partially overlaps with the cutting profile of at least one other cutter element of said one set, wherein said one set comprises:

a first cutter element of said first plurality mounted on a first blade at a first radial position relative to the bit axis;

a second cutter element of said second plurality mounted on a second blade such that the cutting profile of said second cutter element partially overlaps in rotated profile with the cutting profile of said first cutter element, said second cutter element being mounted at a second radial position that is further from the bit axis than said first radial position; and a third cutter element of said third plurality mounted at a third radial position that is further from the bit axis than said second radial position.

18. The drill bit of claim 17 wherein said cutter elements have generally circular cutting faces, and wherein said one set further comprises a plurality of redundant cutter elements mounted on said bit face at said first radial position, said redundant cutter elements at said first radial position having cutting faces that are substantially the same in diameter as said first cutter element.

19. The drill bit of claim 18 wherein said one set further comprises a plurality of redundant cutter elements mounted on said bit face at said second radial position, said redundant cutter elements at said second radial position having cutting faces that are substantially the same in diameter as said second cutter element.

20. The drill bit of claim 17 wherein said cutter elements in said one set have substantially the same exposure height.

21. The drill bit of claim 17 wherein said second cutter element of said one set is mounted on said bit face so as to be less exposed to the formation material than said first cutter element of said one set.

22. The drill bit of claim 17 wherein said second cutter element of said one set is mounted on said bit face so as to be more exposed to the formation material than said first cutter element of said one set.

23. The drill bit of claim 19 wherein said bit face includes a central portion, a gage portion, and a shoulder portion between said gage portion and said central portion, and wherein said cutter elements of said one set are mounted on said bit in said shoulder portion.

24. The drill bit of claim 23 wherein said third cutter element has a curvature that is greater than said first curvature.

* * * * *